US007491139B2

(12) United States Patent
Bridge et al.

(10) Patent No.: US 7,491,139 B2
(45) Date of Patent: Feb. 17, 2009

(54) COLLAPSIBLE BALL GAME PRACTICE DEVICE

(76) Inventors: Kurt A. Bridge, 2302 Shadow Glen Ct., Wexford, PA (US) 15090; Burditt J. Bridge, 2302 Shadow Glen Ct., Wexford, PA (US) 15090

( * ) Notice: Subject to any disclaimer, the term of this patent is extended or adjusted under 35 U.S.C. 154(b) by 0 days.

(21) Appl. No.: 11/472,956

(22) Filed: Jun. 22, 2006

(65) Prior Publication Data

US 2007/0298911 A1 Dec. 27, 2007

(51) Int. Cl.
*A63B 69/00* (2006.01)
*A63B 69/34* (2006.01)
*A63H 33/00* (2006.01)

(52) U.S. Cl. ..... 473/422; 473/438; 473/442; 220/8; 215/900; 446/69; 446/97

(58) Field of Classification Search ..... 473/422, 473/438, 442, 445; 220/8; 446/69; 215/900
See application file for complete search history.

(56) References Cited

U.S. PATENT DOCUMENTS

| | | | | | |
|---|---|---|---|---|---|
| 264,066 | A | * | 9/1882 | Crandall | 434/159 |
| 2,623,329 | A | * | 12/1952 | Di Leva | 446/320 |
| 2,760,303 | A | * | 8/1956 | Del Mas | 446/97 |
| 2,880,902 | A | * | 4/1959 | Owsen | 220/8 |
| 3,084,825 | A | * | 4/1963 | Hultquist | 220/8 |
| 3,407,514 | A | * | 10/1968 | Christian | 434/174 |
| 3,442,045 | A | * | 5/1969 | Green | 446/297 |
| D281,342 | S | * | 11/1985 | Gompes | D21/589 |
| 4,557,378 | A | * | 12/1985 | Klebold | 206/223 |
| 4,784,382 | A | * | 11/1988 | Myers | 248/460 |
| 4,989,862 | A | | 2/1991 | Curtis | 273/1.5 A |
| D321,370 | S | | 11/1991 | Curtis | D19/62 |
| 5,310,380 | A | * | 5/1994 | Levy et al. | 446/489 |
| 5,485,993 | A | | 1/1996 | Lipsett | 273/1.5 A |
| D370,242 | S | | 5/1996 | Bright | D21/201 |
| 5,527,185 | A | | 6/1996 | Davis | 434/248 |
| 5,642,879 | A | | 1/1997 | Rodriguez | 473/448 |
| 5,800,291 | A | | 9/1998 | Grover | 473/447 |

(Continued)

FOREIGN PATENT DOCUMENTS

GB 2368806 A * 5/2002

*Primary Examiner*—Mitra Aryanpour
(74) *Attorney, Agent, or Firm*—Michael F. Petock, Esq.; Petock & Petock, LLC.

(57) ABSTRACT

A collapsible ball game practice device is comprised of a plurality of sections, each section above a lower section being substantially collapsible into the lower section. Detent structure is provided on an upper portion of each lower section and a lower portion of each upper section to secure each upper section when raised to its raised condition. A mounting structure is provided on the bottom of the lowermost section for releasably securing the device to a basketball playing surface. Arms may be rotated to various positions. The arms may be collapsed and slid on a carrier into the uppermost section. A head structure may also be slid into the uppermost section. The sections may be collapsed such that all of them may be collapsed into the lowest section. A handle is provided in the top of the head structure for carrying the entire assembly. The collapsed device may be easily transported and/or stored. The device is particularly useful as a defensive dummy in practicing the games of basketball and volleyball.

12 Claims, 4 Drawing Sheets

U.S. PATENT DOCUMENTS

| | | | | |
|---|---|---|---|---|
| D404,440 | S * | 1/1999 | Watanabe | D21/585 |
| 5,860,556 | A * | 1/1999 | Robbins, III | 220/666 |
| 5,890,985 | A | 4/1999 | Jenney | 473/447 |
| 6,012,994 | A | 1/2000 | Beluse | 473/446 |
| 6,506,094 | B1 * | 1/2003 | Chang | 446/268 |
| 6,572,432 | B1 * | 6/2003 | Tsai | 446/320 |
| 6,866,595 | B1 | 3/2005 | Elder et al. | 473/446 |
| 6,913,551 | B1 | 7/2005 | Foley | 473/448 |
| 7,029,463 | B1 * | 4/2006 | Estudillo | 604/317 |

* cited by examiner

FIG.1
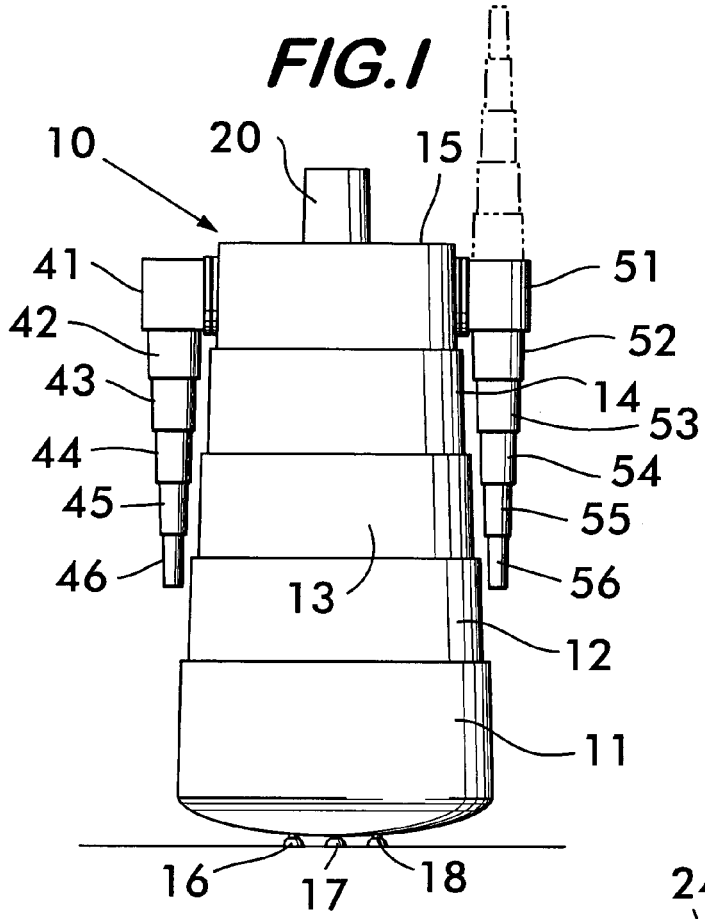
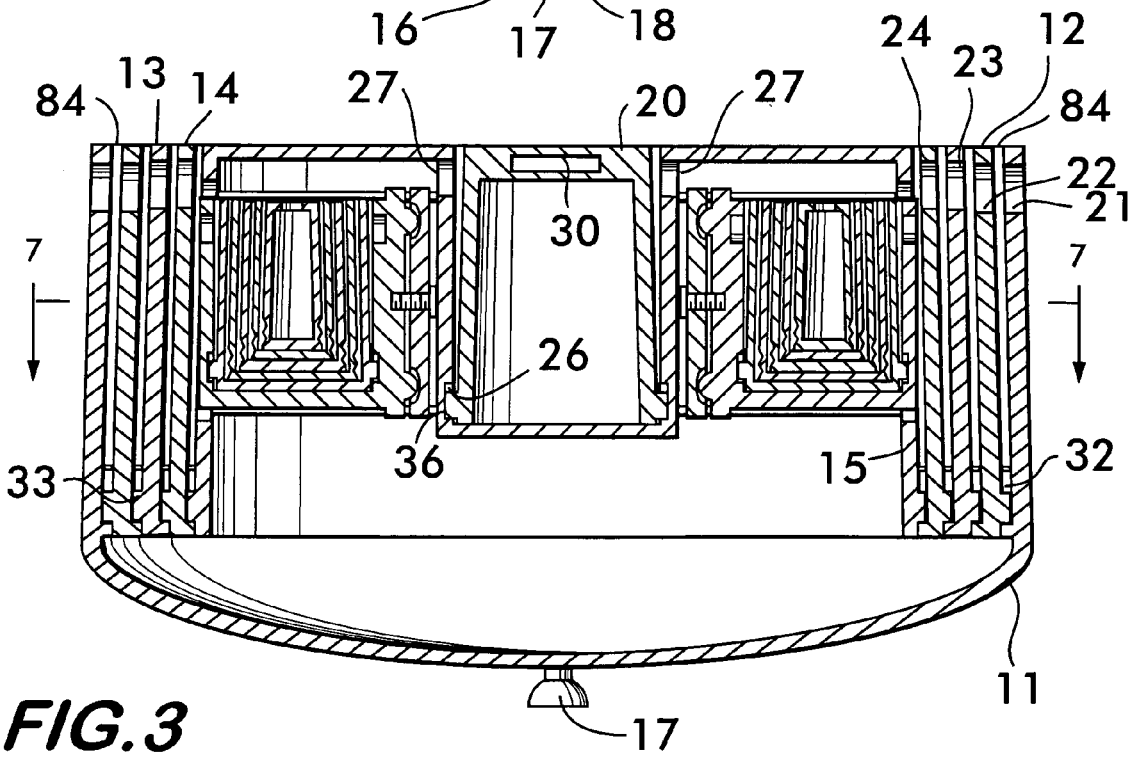
FIG.3

FIG.4
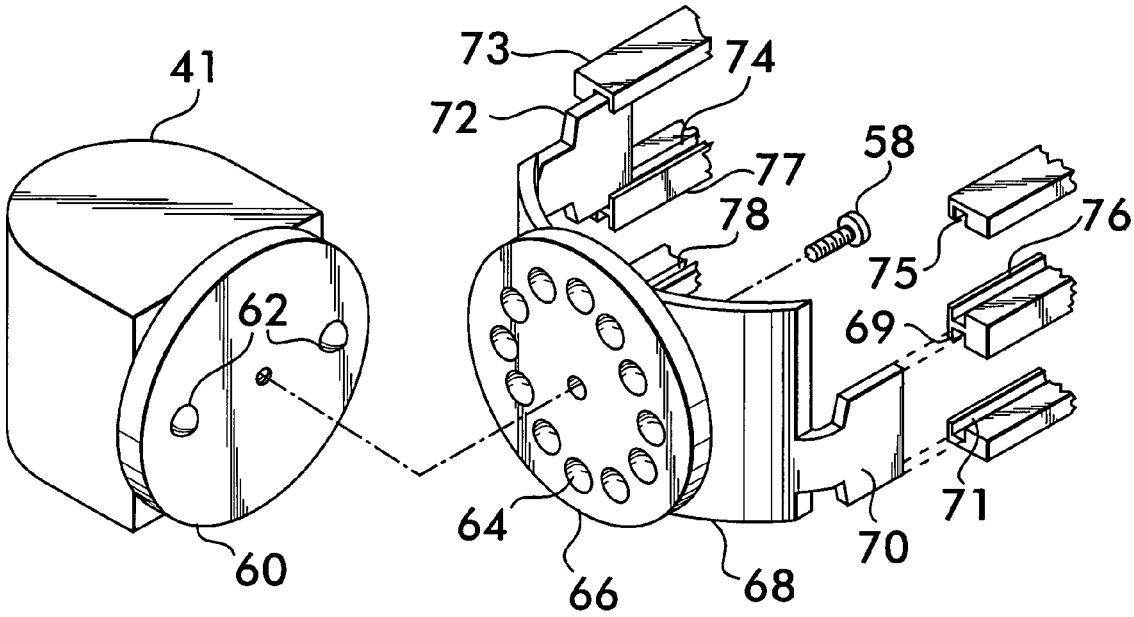
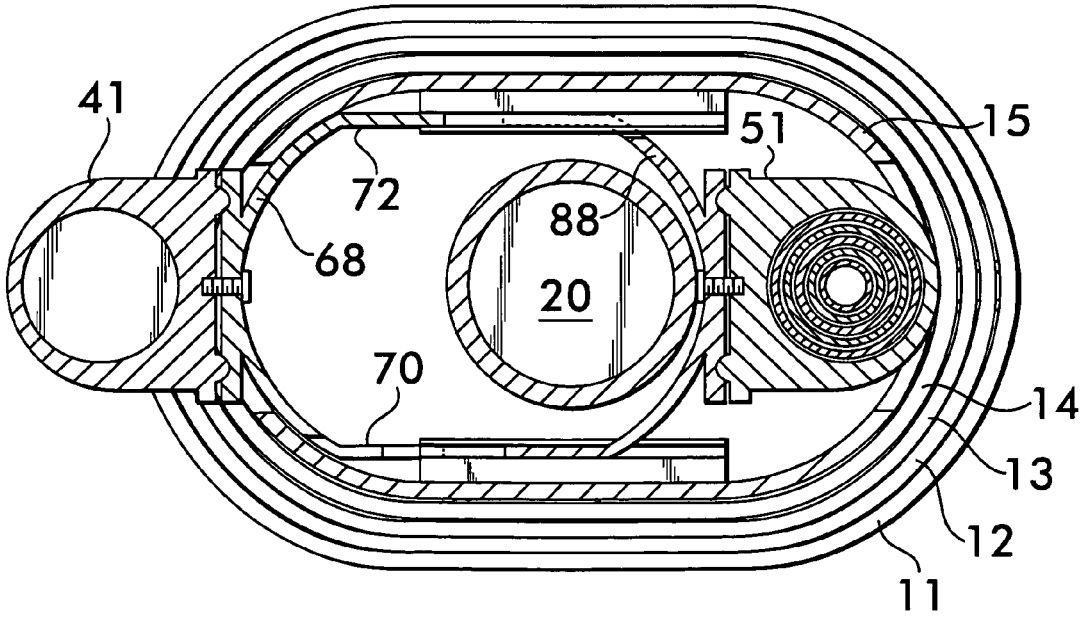
FIG.5

FIG. 6
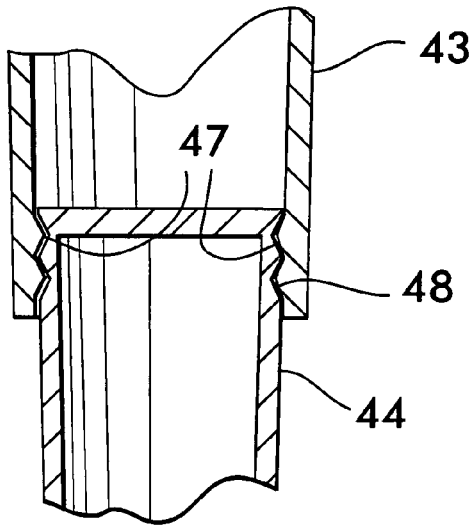
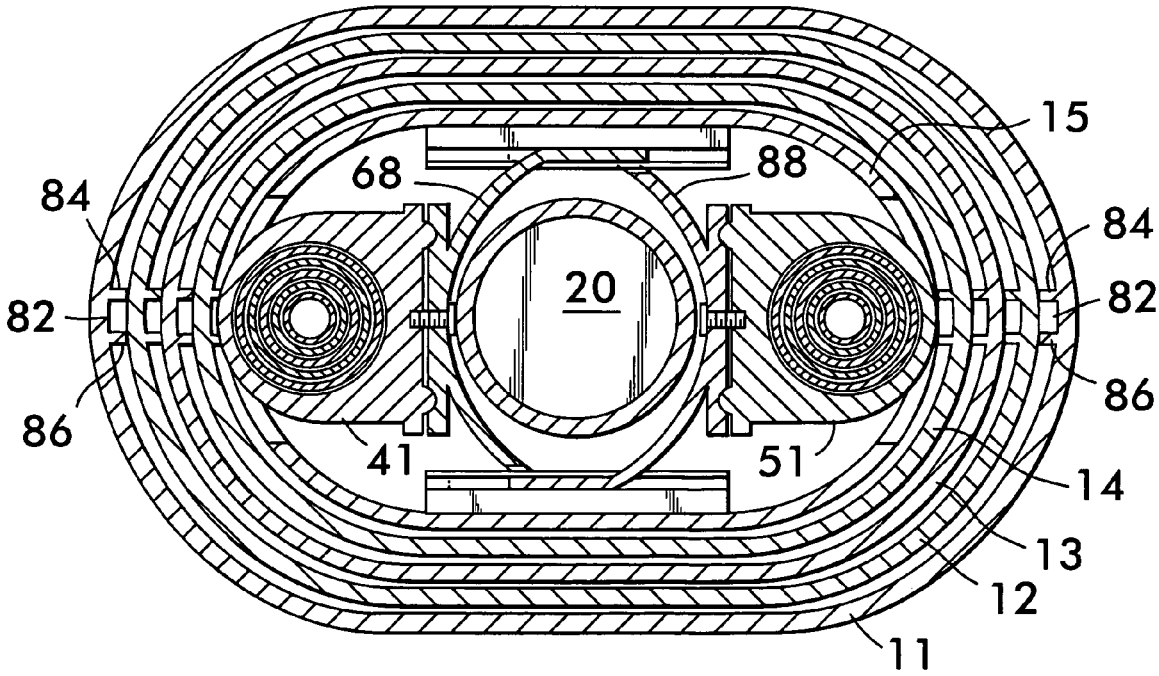
FIG. 7

COLLAPSIBLE BALL GAME PRACTICE DEVICE

FIELD OF THE INVENTION

The present invention relates to a collapsible ball practice device. More particularly, the present invention relates to a collapsible game practice device particularly used for basketball and volleyball wherein portions representing a head and arms may be collapsed into an upper section and all of the sections above a bottom section collapsed into the bottom section for transport and/or storage.

BACKGROUND OF THE INVENTION

To become an accomplished basketball player, many hours of practice are required under conditions simulating as closely as possible actual playing conditions. A person practicing basketball proficiency needs to practice not only making basketball shots from a fixed position into an unobstructed manner, but also practicing shots when there is an obstruction, such as a defensive player in front of him or her. It is often difficult to find a person who will act as a defensive player for extended periods of time and sometimes it is difficult to even find anyone available to participate in a practice session. Accordingly, there is a need for a dummy basketball defensive player for use in practicing the game of basketball. A previous attempt has been made in this area, for example, see U.S. Pat. No. 4,989,862—Curtis. Curtis discloses the use of a basketball dummy player. However, there is also a need to be able to easily transport such a dummy player to a place of basketball game practice. There is also a need to be able to store such a dummy when not in use in a manner which does not take up an inordinate amount of space.

Another ball game where a dummy is particularly useful for practice is that of volleyball. The present invention may be particularly useful in volleyball practice.

SUMMARY OF THE INVENTION

The present invention provides a defensive dummy or ball game practice device particularly useful for basketball and volleyball practice which may be collapsed for transporting the device to and from the place of basketball or volleyball practice and collapsed for storing the device when it is not in use.

In accordance with the present invention, the ball game practice device may be quickly and easily extended or raised to the full height of a normal player and provided with a head and moveable positionable arms.

An advantage of the present invention is that the entire device may be quickly and easily collapsed into one of a plurality of sections making up the device.

Briefly and basically, in accordance with one preferred embodiment of the invention, a device is provided for use by practicing ball players which comprises a plurality of sections, each section above a lower section being substantially collapsible into the lower section. Means are provided on an upper portion of each lower section and a lower portion of each upper section to secure each upper section when raised. Mounting means are provided on the bottom of the lower section for releasably securing it to a ball playing surface. Each upper section may be raised and secured for play, and collapsed substantially completely into the lowest section for transport and/or storage.

Additionally, in accordance with the present invention, the collapsible ball game practice device of the present invention may be provided with a head which may be collapsible into the uppermost portion. Additionally, the collapsible ball game practice device of the present invention may be provided with collapsible rotatable arms which may be rotatably mounted to the uppermost section and the arms may be collapsed and slid into the uppermost section such that the arms and head are contained within the uppermost section and all of the upper sections are collapsible into the lowermost section.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is an elevation view of a collapsible ball game practice device in accordance with the present invention.

FIG. 3 is a cross sectional view corresponding to the cross sectional line of FIG. 2 with the collapsible ball game practice device of the present invention collapsed.

FIG. 4 is an exploded view of the upper arm as mounted on a slidable structure for slidably receiving it within the uppermost section.

FIG. 5 is a cross sectional view taken along line 5-5 of FIG. 2 except that the arm on the right hand side of FIG. 2 has been collapsed and slid into the uppermost section.

FIG. 6 is an expanded cross sectional view of the area of FIG. 6 shown on FIG. 2 showing a detent mechanism for the arm.

FIG. 7 is a cross sectional view taken along line 7-7 of FIG. 3.

DETAILED DESCRIPTION OF THE PREFERRED EMBODIMENTS

Figure 2:
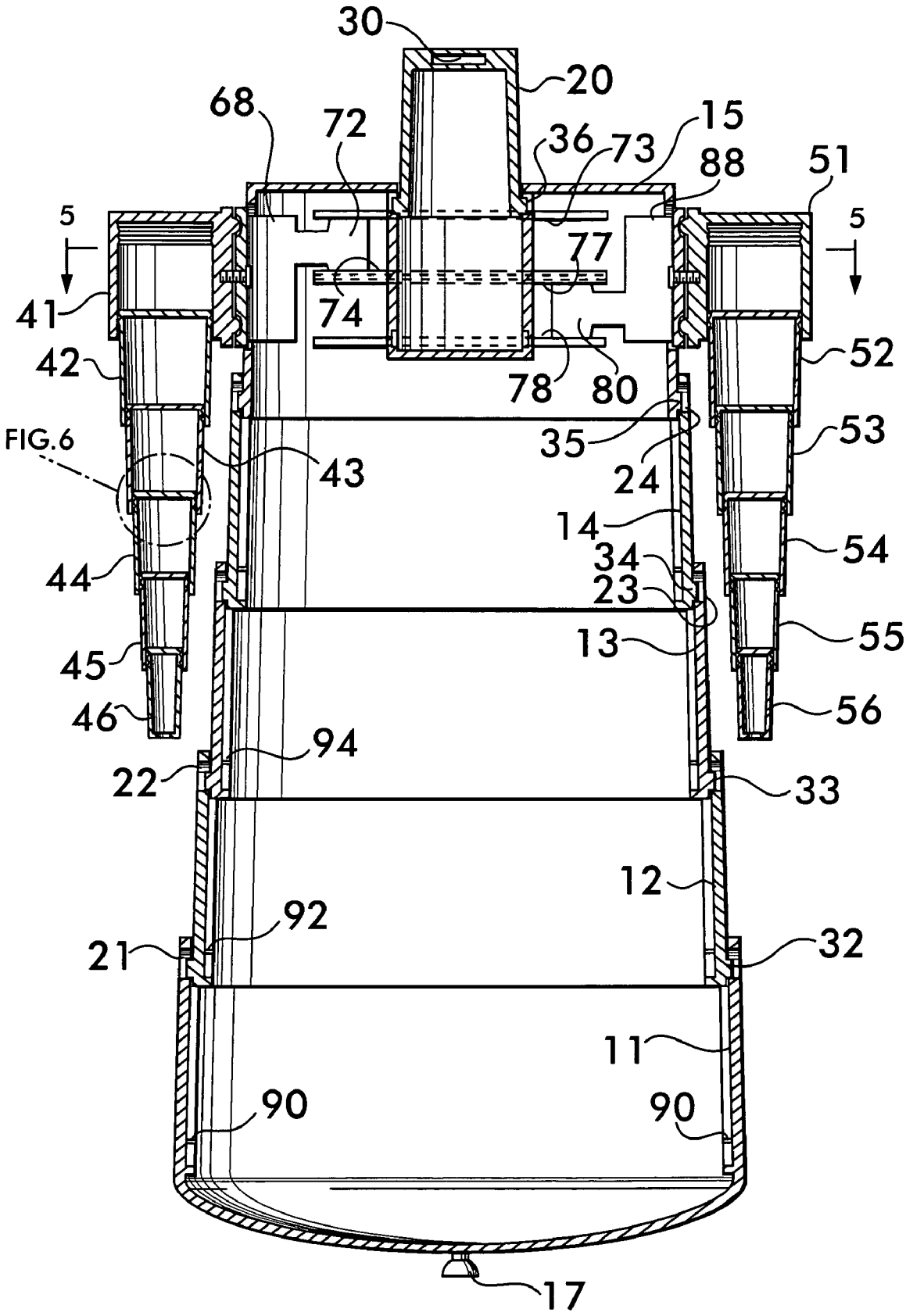
FIG. 2 is a cross sectional view taken through FIG. 1.

Referring now to the drawings in detail, wherein like numerals indicate like elements, there is shown in FIG. 1 a collapsible ball game practice device 10. The device 10 is shown in FIGS. 1 and 2 in its extended form where it may be used for basketball practice on the basketball court or other basketball playing surface or used for volleyball practice on a volleyball court. Device 10 include sections 11, 12, 13, 14 and 15. Section 11 may be referred to as the lowermost section and section 15 may be referred to as the uppermost section. Sections 12, 13, 14 and 15 may be collapsed, when the arms are collapsed and slid into uppermost section 15, into lowermost section 11 as seen for example in the cross sectional view of FIG. 3. Sections 11 through 15 may be made of any suitable fairly rigid material which has sufficient flexibility to enable resilient detent projections to operate. A presently preferred embodiment of the present invention would be comprised of plastic, such as polyurethane. However, other suitable materials may be utilized.

Sections 11 through 15 may be of any suitable mating shape in cross section, such as round or other shapes, but preferably a non-round somewhat flattened ellipsoidal shape as illustrated in FIGS. 5 and 7 may be used. If sections 11 through 15 where round, it would be preferable to provide some type of a vertical detent mechanism or channel to prevent rotation of one section with respect to its adjacent section or sections. Such channels are provided, although unnecessary with the flattened ellipsoidal section shape, as channel 82 comprised of side rails 84 and 86 as illustrated in FIG. 7 on Section 11.

Although five sections are illustrated as sections 11 through 15, it is understood that more or less sections may be utilized. In a presently preferred embodiment, each section may have a height of approximately 12 inches. However, it is understood that the height of the sections may vary within the range of 10 inches up to 18 or more inches. The desired height of the sections may be selected to produce a height of the combined sections between 5 and 7 feet as desired. Furthermore, if less sections were used, each section would be of an increased height whereas if more sections were utilized, the height of each of section may be decreased somewhat. As may be seen from FIG. 3, when completely collapsed, all of the sections, arms and head would be contained within the lowermost section, and it may be desirable to have a reduced height for each section with more sections.

The lowermost section, section 11, may be provided with mounting means on the bottom of section 11 for releasable securing it to a basketball playing surface, such as suction cups 16, 17 and 18. However, it is understood that other mounting means may be utilized to secure device 10 to a basketball playing surface.

As may be best seen in FIG. 2, there is means on the upper portion of each lower section, such as openings 21, 22, 23 and 24 and projections on the lower portion of each upper section, such as projections 32, 33, 34 and 35 to secure each upper section when raised. Other various types of detent structures may be utilized to hold the upper sections in the raised position and release them for lowering, but the holes 21-24 and mating projections 32-35 are presently preferred.

Uppermost section 15, and it is understood that it could be a different section if more or less sections were utilized, is provided with a head structure 20. Head structure 20 may be provided with similar detent mechanism which includes projections 36 on the lower end of head structure 20 and two pairs of mating openings 26 and 27 so that the head may be secured in either its raised or extended position and also in its collapsed position for carrying or storage. Head structure 20 is provided with a handle 30 which may be utilized for carrying the entire device when collapsed as shown in FIG. 3.

Head 20 may be provided with a decal, painting or other facsimile or representation of a face of either an anonymous person or a famous basketball player. Similarly, sections 11 through 15 or other number of sections may be provided with decals, artistic paintings or other representation of a body, jersey and/or shorts of a particular basketball team. The arms, to be discussed, may also be provided with decals or artist work as desired.

Referring now most particularly to FIGS. 1 and 2, device 10 is shown as being provided with collapsible arms comprised of sections, a right arm being comprised of sections 41, 42, 43, 44, 45 and 46 (shown in left side of FIG. 2) and a left arm comprised of sections 51, 52, 53, 54, 55 and 56. Arm sections 41 and 51 are rotatably mounted to a slide carrier mounted within uppermost section 15. Arm sections 42 through 46 are slidably collapsible into arm section 41. Arm sections 52 through 56 are slidably collapsible into arm section 51. The arm sections 41 through 46 and 51 through 56 are provided with detent mechanisms for securing the arm sections in their extended position. One example of such a suitable detent mechanism is shown in FIG. 6. As illustrated in FIG. 6, arm sections 43 and 44, as well as the other arm sections, may be provided with mating indentations 47 and 48 which may be snapped into place and forcibly released when it is desired to collapse the arms.

An exploded view of the rotatable mounting structure of uppermost arm section 41 is shown in FIG. 4. As may be seen in FIG. 4, arm section 41 may be provided with a circular disk 60 having one or more projections 62 which mate with openings 64 contained on a second disk 66 mounted on a slide carrier 68. Disk 60 is mounted to disk 66 by means of a screw, rivet or other suitable fastener 58. Slide carrier 68 may be provided with guides or slide bars 70 and 72 which ride in channels or tracks. Guide or slide bar 70 rides in channels or tracks 69 and 71 and guide or slide bar 72 rides in channels or tracks 73 and 74. The channels or tracks extend across the entire width of the upper section 15 of device 10. The slide carrier for upper arm section 51 on the other side of the device would ride in the remaining channels shown, that is, channel 75 and 76 on the one side and channel 77 and 78 on the other side. This structure is best illustrated by viewing FIG. 4 in conjunction with FIG. 2. For example, as may be seen in FIG. 2, track or slide bar 80 of slide carrier 88 may be seen riding in channels 77 and 78. By providing a double set of channels spaced one above the other, the slide carriers 68 and 88 may be completely slid into uppermost section 15 allowing the collapsed arms to be contained within uppermost section 15. This is illustrated in FIG. 3. Further, FIG. 5 illustrates the arm on the right side of the page as being collapsed and contained within uppermost section 15 while slide carrier 68 is in its extended position with upper arm section as well as the remaining arm sections 42-46 being in their extended position. The arms may be positioned in various locations, such as vertically as shown in FIG. 1 or any other position 360 degrees around as provided by the disks 60 and 66 illustrated in FIG. 4.

When the extended or raised sections, as shown in FIGS. 1 and 2, are desired to be collapsed, the arms are collapsed, and the slide carriers 68 and 88 carrying the arms are slid into uppermost section 15. The sections may then be collapsed by depressing the projecting members. For example, by depressing projecting members 35 and pushing them back out of their openings 24, uppermost section 15 may be collapsed into section 14. By depressing projecting member 34 out of opening 23, section 14 may be collapsed into section 13. In a similar manner, section 13 may be collapsed into section 12 and then section 12 collapsed into section 11 resulting in all of the sections 12 through 15 being collapsed into section 11. As the sections are collapsed, the projecting members 32-35 ride in channels, such as channel 82 for section 11 which is comprised of side rails 84 and 86. Each section has such channels. A transverse member, such as member 90 for channel 82, is provided across a lower portion of each channel wherein the corresponding projecting member, such as projecting member 32 on section 12, may be retained. In this manner, a detent mechanism is provided when the unit is collapsed holding all of the sections in their collapsed condition for transport when the device is picked up by its handle 30. Transverse member 92 is provided in the channels in section 12 and transverse member 94 is provided in the channels in section 13. Similar transverse members are provided in the channels in the other sections. The projecting members in connection with the transverse members in the channels comprise a second detent mechanism which is used to hold the sections in their lowered or collapsed position for carrying.

In accordance with the present invention, the collapsible basketball game practice device may be readily carried by handle 30 in its collapsed form to a place for basketball practice, such as a basketball court, may be readily expanded or raised by lifting or forcing the sections to their raised positions and locking them in place by the detent mechanisms, sliding the arms out of uppermost section 15, extending the arms, positioning the arms to their desired defensive position and raising the head structure 20 of the device. The device may be temporarily or releasably secured to the basketball playing surface by suction cups 16, 17 and 18 for other suitable releasable securing means. During play, the position of the device may be changed and/or the position of the arms may be changed. Upon completion of the practice session, the device may be quickly and easily collapsed for carrying back to the place of storage. In collapsing the device, the arms would be collapsed, once collapsed, the arms would be slid into uppermost section 15, head structure 20 would be collapsed into uppermost section 15, section 15 collapsed into section 14, the combined sections 14 and 15 would be then collapsed into section 13, the combined sections 13, 14 and 15 would then be collapsed in section 12 and finally the combined sections 12 through 15 with the head and arm structure would be collapsed into lowermost section 11. With the second detent or lower detent mechanism holding the sections in their collapsed position, the complete device may be carried by its handle 30.

The present invention may be embodied in other forms and is not limited to the particular embodiments shown. For example, various detent mechanism may be utilized. Various shapes may be utilized for the collapsible sections. The arms which are shown as round may be non round.

In view of the above, the present invention may be embodied in other specific forms without departing from the spirit or essential attributes thereof and, accordingly, reference should be made to the appended claims, rather than to the foregoing specification as indicating the scope of the invention.

We claim:

1. A device for use as a defensive game dummy for practicing basketball or volleyball, comprising:

a collapsible body, collapsible arms and a collapsible head which may be positioned as a defensive dummy;

said collapsible body being comprised of a plurality of sections, each section above a lower section being substantially slidably collapsible into the lower section;

means on an upper portion of each lower section of said body and on a lower portion of each upper section of said body to secure each upper section of said body when raised;

mounting means on a bottom of a lowest section of said body for releasably securing it to a surface;

said upper sections of said body may be raised and secured for play and collapsed substantially completely into the lowest section of said body for transport and/or storage;

said upper and lower sections of said body being round or ellipsoidal in cross section;

a head section of a size smaller than said upper and lower body sections mountable to an uppermost section of said body and collapsible into said uppermost section of said body, representing a head of a dummy player;

said uppermost section being provided with collapsible rotatable arms mounted thereto, said arms being comprised of collapsible sections wherein said arms may be collapsed and slid into said uppermost section of said body, said collapsible section of said arms may be extended and secured in an extended position by detent mechanisms, said arms being rotatable to various positions to function as a game dummy;

said head being collapsible into said uppermost section of said body and said arms being collapsible into said uppermost section of said body wherein the upper sections of the body may be collapsed into lowermost section of the body with the entire device being collapsed into the height of a single section;

said head section being provided with detent mechanisms for retaining said head in an extended position or in a collapsed condition; and said head being provided with a handle for carrying said device.

2. A device in accordance with claim 1 wherein said means on the upper portion of each lower section and the lower portion of each upper section to secure each upper section when raised comprises a detent mechanism.

3. A device in accordance with claim 2 wherein said detent mechanism is comprised of an opening in the upper portion of each lower section and a projection on the lower portion of each upper section.

4. A device in accordance with claim 3 wherein said projection may be depressed to unsecure and lower an upper section.

5. A device in accordance with claim 1 wherein said mounting means on the bottom of the lowest section is comprised of suction cups.

6. A device in accordance with claim 1 wherein each body section has a height in the range of approximately 10 to approximately 18 inches.

7. A device in accordance with claim 1 including a second detent mechanism for securing the plurality of sections in the collapsed position wherein all of the upper sections are collapsed into said lowermost section.

8. A device in accordance with claim 1 wherein said dummy is used as a defensive dummy for use in practicing the games of basketball and/or volleyball.

9. A device, comprising:

a defensive game dummy having a collapsible body and a pair of rotatably adjustable collapsible arms;

said collapsible body being comprised of a plurality of body sections, each said body section being slidably collapsible into an adjacent body section;

means on said body sections for securing said body sections in an expanded condition;

means on said body sections for securing said body sections in a collapsed condition;

a head section of reduced diameter mounted to an uppermost body section and being collapsible into said uppermost body section;

means for securing said reduced diameter head section in an extended position;

means for securing said reduced diameter head section in a collapsed condition within said uppermost body section;

a pair of carriers movably mounted in said uppermost body section for carrying said pair of collapsible arms;

a releasably lockable pivot structure mounted on each of said pair of carriers enabling rotatable adjustment of said arms;

each of said pair of carriers being movable towards the center of said uppermost body section for carrying a collapsed arm and being moveable towards a periphery of said uppermost body section to enable extension of said collapsible arm;

each of said arms being made of a plurality of collapsible sections;

means for securing each arm section in an extended position;

means for securing each arm section in a collapsed condition; and said reduced diameter head section being provided with a handle for carrying said defensive dummy.

10. A device in accordance with claim 9 wherein a lowermost body section is provided with means for securing said defensive game dummy to a surface.

11. A device in accordance with claim 10 wherein said means for attaching are suction cups.

12. A device in accordance with claim 9 wherein said arms may be collapsed onto said carriers and slid into said uppermost body section, said head section may be collapsed into said uppermost body section and all body sections above a lowermost body section may be collapsed into said lowermost body section.

* * * * *